US006000177A

United States Patent [19]

Davidson

[11] Patent Number: 6,000,177

[45] Date of Patent: Dec. 14, 1999

[54] BUILDING STRUCTURE HAVING THE APPEARANCE OF A LOG STRUCTURE

[76] Inventor: William Scott Davidson, 801 Chinn St., Raceland, Ky. 41169

[21] Appl. No.: 08/944,171

[22] Filed: Oct. 6, 1997

Related U.S. Application Data

[60] Provisional application No. 60/027,993, Oct. 9, 1996.

[51] Int. Cl.[6] ..... E04B 1/10

[52] U.S. Cl. ..... 52/233

[58] Field of Search ..... 52/233, 282.1, 52/284, 286

[56] References Cited

U.S. PATENT DOCUMENTS

| | | | |
|---|---|---|---|
| 1,996,735 | 4/1935 | King | 20/4 |
| 2,005,921 | 6/1935 | Reither | 52/233 |
| 2,110,787 | 3/1938 | Brandjord | 52/233 |
| 2,309,426 | 1/1943 | Williams | 52/233 |
| 4,056,906 | 11/1977 | Elfstrom | 52/233 |
| 4,096,674 | 6/1978 | Kollar et al. | 52/233 |
| 4,277,925 | 7/1981 | Kinser | 52/233 |
| 4,320,610 | 3/1982 | Rupp | 52/233 |
| 4,330,973 | 5/1982 | Marklund et al. | 52/233 |
| 4,429,500 | 2/1984 | Farmont | 52/233 |
| 4,503,647 | 3/1985 | Post | 52/233 |
| 4,592,182 | 6/1986 | Felser | 52/233 |
| 4,627,204 | 12/1986 | Smith | 52/233 |
| 4,640,062 | 2/1987 | Rubik | 52/109 |
| 4,878,328 | 11/1989 | Berge | 52/233 |
| 5,010,701 | 4/1991 | Halsey, Jr. et al. | 52/233 |
| 5,325,645 | 7/1994 | Wrightman | 52/233 |
| 5,608,997 | 3/1997 | Mahowich | 52/233 |
| 5,638,649 | 6/1997 | Hovland | 52/233 |

*Primary Examiner*—Beth Aubrey

*Attorney, Agent, or Firm*—Weingarten, Schurgin, Gagnebin & Hayes LLP

[57] ABSTRACT

A building structure which simulates the appearance of a traditional log structure while incorporating modern wood framing construction techniques is disclosed. A number of interlocking log heads form the corner of the structure. Each log head abuts against a stud or post displaced a distance from the corner. Wall boards are affixed to extend horizontally over sheathing attached to studs and abut each log head. Small spaces between the wall boards are filled with a chinking element, which may be a wood strip covered with a suitable surface material to simulate actual chinking.

26 Claims, 5 Drawing Sheets

BUILDING STRUCTURE HAVING THE APPEARANCE OF A LOG STRUCTURE

CROSS REFERENCE TO RELATED APPLICATIONS

This application claims the benefit under 35 U.S.C. § 119(e) of U.S. Provisional Application No. 60/027,993, filed on Oct. 9, 1996, the disclosure of which is incorporated by reference herein.

STATEMENT REGARDING FEDERALLY SPONSORED RESEARCH OR DEVELOPMENT

Not Applicable

BACKGROUND OF THE INVENTION

Typical log structures are constructed of logs stacked vertically to form a wall. The lower and upper surfaces of the logs are planed to abut closely against the adjacent logs. Chinking is applied between the horizontal joints of the logs. At the corners, the logs are notched to receive logs from the adjacent wall, with the ends of each log protruding somewhat beyond the notch. Such log structures have an attractive appearance, but are time consuming and expensive to build in the traditional manner. The logs themselves are extremely heavy and frequently require a crane or other large piece of equipment to lift into place. Also, the availability of full size logs has decreased, particularly in light of increased concern for the growth of large trees and the habitat they provide.

BRIEF SUMMARY OF THE INVENTION

The present invention provides a building structure which simulates the appearance of a traditional log structure while incorporating modern wood framing construction techniques. More specifically, the invention provides a number of log heads which form the corner of the structure. Each log head is notched to receive an abutting log head from the adjacent wall to form an interlocking joint. Each log head also abuts against a stud or post to which it is appropriately fastened. A number of different types of log heads are provided by the present invention.

Spaced away from the corners, the structure's walls are framed with studs or posts and top and bottom plates, the placement of which is determined by the dimensions of the walls and the location of features such as windows and doors. Insulation is placed between the studs, and sheathing is placed over the studs on both the inside and the outside of the walls.

Wall boards are affixed to extend horizontally over the inner and outer sheathing with small spaces between vertically adjacent wall boards. The small spaces are filled with a chinking element, which can be a wood strip covered with a suitable surface material to simulate actual chinking.

The joints between the log heads and the wall boards can be angled or mitered or otherwise formed to minimize the appearance of a joint. Screws and nails can be countersunk and disguised with simulated knot holes. In this manner, the log heads and wall boards present the appearance of continuous logs as in a traditional log structure. However, the log heads and wall boards of the present invention weigh considerably less than full size logs. Construction of the structure is thereby simplified and less costly.

BRIEF DESCRIPTION OF THE DRAWINGS

The invention will be more fully understood from the following detailed description taken in conjunction with the accompanying drawings in which.

DETAILED DESCRIPTION OF THE INVENTION

Figure 1:
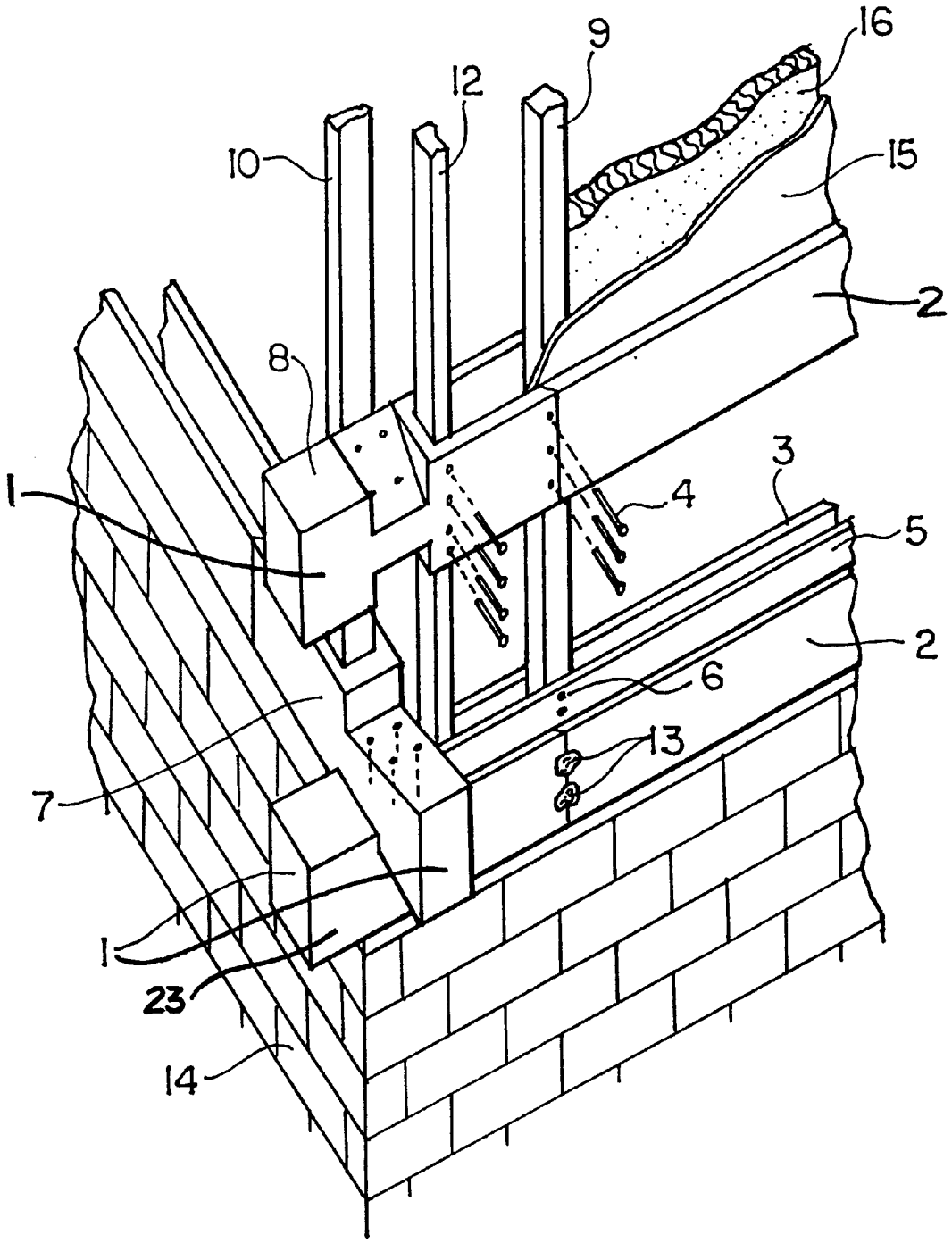
FIG. 1 is an exploded perspective view of a log structure according to the present invention.
Figure 2:
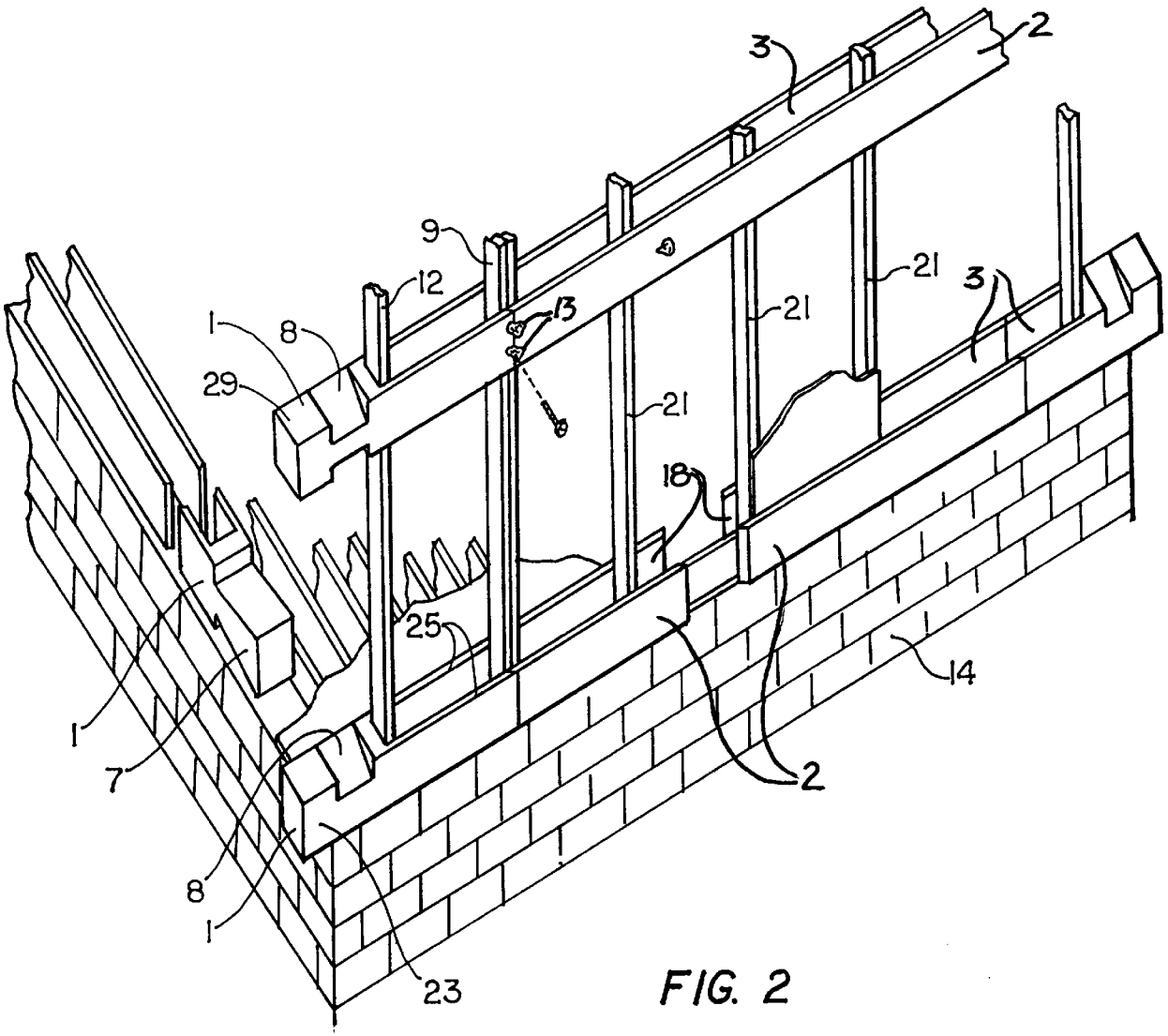
FIG. 2 is a further exploded perspective view of the log structure according to the present invention.

Referring to FIGS. 1 and 2, the log structure according to the present invention is formed of a number of components comprising log heads 1, exterior wall boards 2, interior wall boards 3, and chinking 5. The log heads form an interlocking joint at the corner of the log structure with log heads from one wall alternating with log heads from the adjacent wall. The exterior and interior wall boards 2,3 encase or surround studs or posts 9, 10, 12, 21 which form the walls of the structure, as in traditional construction. The chinking 5 is provided between vertically adjacent wall boards 2,3.

The log structure is supported on a traditional foundation wall 14 in any suitable manner. However, unlike traditional construction, the present invention does not use a corner post, i.e., a post situated directly over the corner of the wall. Rather, the log heads 1, which form the corner, are attached to starter studs 10, 12 which are spaced inwardly from the corner a suitable distance. If a new building is constructed, the corner post of traditional wood frame construction is merely omitted. If an existing building is remodeled, the existing corner post is removed. As with traditional construction, insulation 16 is placed between the studs, and sheathing 15 is fastened over the studs. The sheathing lies between the studs and the log wall boards.

The log heads are appropriately notched on upper and lower surfaces to form a suitable joint. For example, every other one of the log heads may include a dove tail 7 and alternating log heads may include appropriate notches 8 to receive the dove tails 7. Other joints, such as a half lap joint, can be used. A starter log head 23 at the bottom of the wall is notched on the top surface only. The log heads are fastened to each other in a suitable manner, such as with countersunk screws 4 and glue.

The exterior and interior wall boards 2,3 are fastened to the studs in a suitable manner, such as with countersunk screws and glue. The ends 18 of the interior and exterior wall boards are angled to join to correspondingly angled ends 19 of the log heads and ends 18 other wall boards. A post, such as a 4×4 post 9 or stud, is placed wherever log heads join wall boards, wall boards join adjacent wall boards, or at joints with a window jam or door jam.

Figure 3:
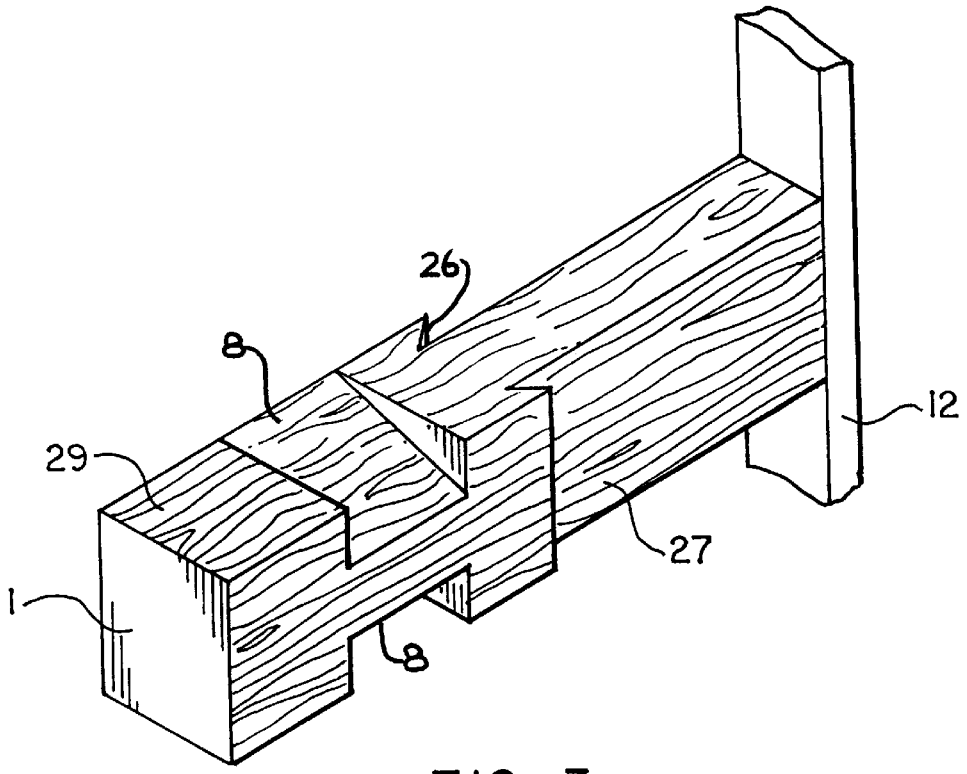
FIG. 3 is a perspective view of a male configuration of a log head according to the present invention.
Figure 5:
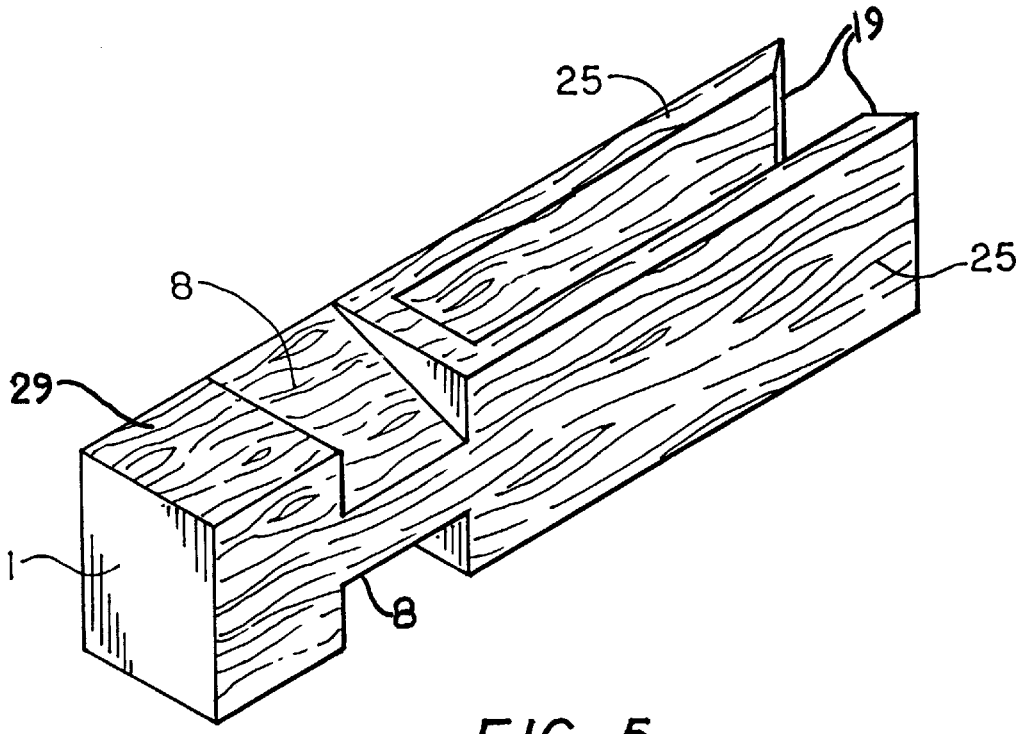
FIG. 5 is a perspective view of a female configuration of a log head according to the present invention.
Figure 6:
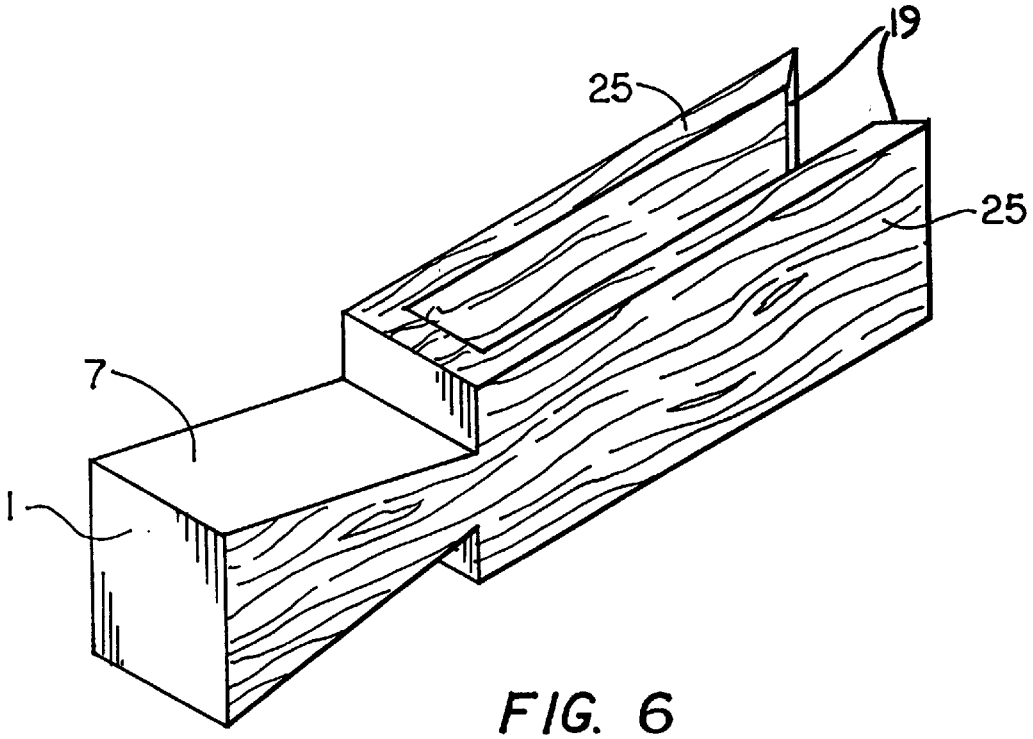
FIG. 6 is a perspective view of a further female configuration of a log head according to the present invention.

The log heads 1 can be formed in a male configuration (FIGS. 3 and 4) or a female configuration (FIGS. 5, 6, and 7) for attachment to the starter studs. In the female configuration (see also FIGS. 1 and 2), the log end includes two opposed interior and exterior wall extensions 25 which surround or encase the starter stud. The length of the extensions is sufficient to attach to the next adjacent stud or post as with countersunk screws 4 and glue. The ends 19 of the wall extensions are angled for joining to the angled ends 18 of the interior and exterior wall boards, as discussed above. The length of the extensions can vary from log head to log head to stagger the joints, if desired.

Figure 4:
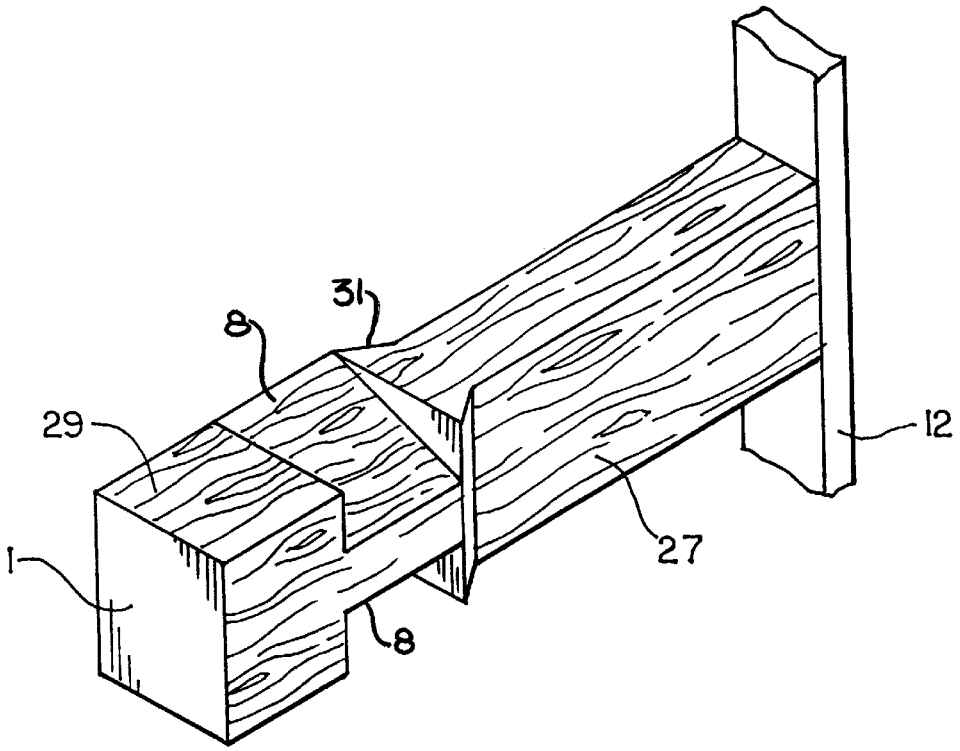
FIG. 4 is a perspective view of a further male configuration of a log head according to the present invention.
Figure 7:
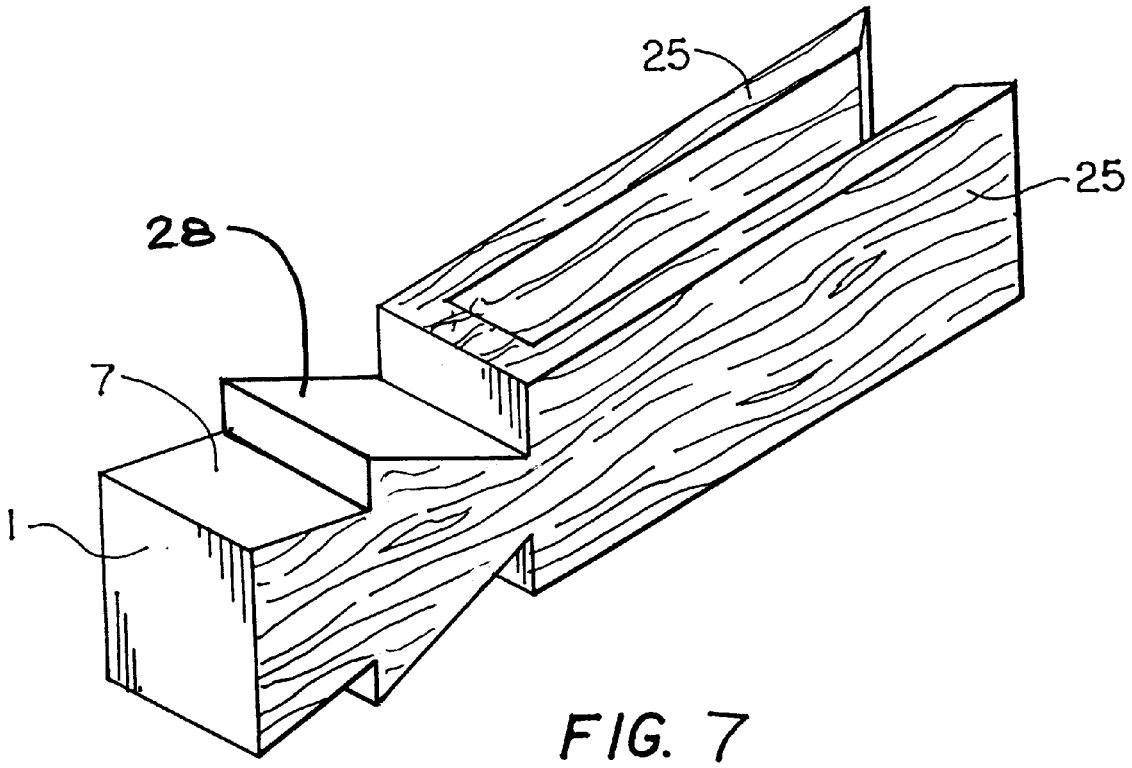
FIG. 7 is a perspective view of a still further female configuration of a log head according to the present invention.

In the male configuration (shown in FIGS. 3 and 4), the log head includes a extension 27 which butts against the starter stud 12. The log head is angled at a location 26 spaced from the stud to receive ends 18 of interior and exterior wall boards 2,3, which thereby extend past the starter stud 12 and are fastened to the starter stud and log head 1 in any suitable manner, as with countersunk screws and glue. By combining both male and female configurations, a staggering of the joints can be achieved. The male configuration illustrated in FIG. 4 is similar to that in FIG. 3, but includes an outwardly angled cut 31 which is located closer to the notch 8 and allows for minimal joint exposure when viewed. The female configuration illustrated in FIG. 7 is similar to that in FIG. 6, but includes a bi-angle or double dovetail joint 28 which allows this log head to seat and fit properly with the double notched leg head of FIG. 5 and provide a more aesthetic appearance.

The ends 29 of the log heads can be shaped in various ways if desired. For example, they could be square or flat, octagonal, semi round, with rounded corners, or scalloped or hewed.

The chinking 5 is placed between vertically adjacent wall boards 2, 3. The chinking is formed of a wood strip covered with a suitable surface material, such as insulated tin roofing, paint (generally white to best simulate actual chinking), stucco, or a mesh material. The chinking is fastened to the studs in any suitable manner, as with chinking nails 6.

Inlaid knot holes 13 are provided to disguise the joints. For example, a knot hole is placed in the countersunk opening over the screws used to fastened the log heads and boards to the studs. The knot hole may be fastened in any suitable manner, as with glue. The inlaid knot holes add to the realistic appearance of the log structure.

The exterior and interior boards 2,3 can be formed from standard sized 2×12, 2×10, or 2×8 boards. The log heads can be formed from a solid block of wood adapted to these standard sizes. Any suitable wood can be used for the log heads, interior and exterior boards, and chinking. Southern pine is a suitable wood which is also desirable for economical reasons. The exterior wood is preferably treated for exterior use to make it resistant to moisture, mildew, and insects. The use of other materials, preferably materials which simulate the behavior and appearance of wood, can also be used in the present invention.

The log structure of the present invention is advantageous in that it adapts well to remodeling of existing structures. It is readily constructed, since the components are easy to handle without a crane or lift. The heaviest component is approximately 70 pounds, whereas a solid log can weigh between 250 and 500 pounds. Its lighter weight provides for safer construction as well. In addition, the components conserve wood, using from 50 to 60% less wood than in a traditional log structure. The materials used for the log heads and wall boards are readily available throughout the United States and many parts of the world. The log structure is more energy efficient, since the structure can be insulated with state-of-the-art insulation materials.

The invention is not to be limited by what has been particularly shown and described, except as indicated by the appended claims.

I claim:

1. A building structure comprising:

a foundation;

a plurality of vertically oriented, horizontally spaced studs or posts arranged on the foundation to define at least two walls joined at a corner joint, a first one of the studs or posts associated with a first wall of the two walls forming a first starter stud and being displaced along the first wall from the corner joint between the two walls, a second one of the studs or posts associated with a second wall of the two walls forming a second starter stud and being displaced along the second wall from the corner joint between the two walls, sheathing fastened to the studs or posts to form inner and outer wall surfaces;

a plurality of log heads configured to form the corner joint of the building structure, each log head comprising a solid section having at least one cut away portion therein configured to receive an adjacent log head and an extension section configured to abut against the first and second starter studs displaced from the corner joint between the two walls, the log heads arranged in abutting relationship with adjacent log heads on adjacent walls to form the corner joint of the building structure, first ones of the log heads attached to the first starter stud and second ones of the log heads attached to the second starter stud, the first and second ones alternating vertically along the corner joint between the two walls; and a plurality of wall boards attached to at least one of the inner and outer wall surfaces, the wall boards arranged horizontally and spaced vertically to abut an associated one of the extension sections of the log heads.

2. The building structure of claim 1, wherein the log heads and wall boards are formed from wood.

3. The building structure of claim 1, further comprising chinking elements attached to at least one of the inner and outer wall surfaces between the wall boards.

4. The building structure of claim 1, further comprising insulation placed between the studs or posts.

5. The building structure of claim 1, wherein the extension section of at least one log head comprises an extension having a length sufficient to abut against the first or second starter stud.

6. The building structure of claim 5, wherein the solid section includes an angled surface to receive a correspondingly angled surface on an end of an adjacent one of the plurality of wall boards.

7. The building structure of claim 6, wherein the angled surface is inwardly facing.

8. The building structure of claim 6, wherein the angled surface is outwardly facing.

9. The building structure of claim 1, wherein the log heads are fastened to the first or second starter studs with countersunk screws or nails, and inlaid knot holes are located over the heads of the countersunk screws or nails.

10. The building structure of claim 1, wherein joints at which the log heads abut the walls boards are angled.

11. The building structure of claim 1, wherein the cut away portion comprises an angled surface formed in an upper side.

12. The building structure of claim 1, wherein the cut away portion comprises an angled surface formed in a lower side.

13. The building structure of claim 1, wherein the cut away portion comprises a dove tail formed in the solid portion.

14. The building structure of claim 1, wherein the cut away portion comprises two notches, one of the two notches formed in an upper side, and the other of the two notches formed in a lower side.

15. A building structure comprising:

a foundation;

a plurality of vertically oriented, horizontally spaced studs or posts arranged on the foundation to define at least two walls joined at a corner joint, a first one of the studs or posts associated with a first wall of the two walls forming a first starter stud and being displaced along the first wall from the corner joint between the two walls, a second one of the studs or posts associated with a second wall of the two walls forming a second starter stud and being displaced along the second wall from the corner joint between the two walls, sheathing fastened to the studs or posts to form inner and outer wall surfaces;

a plurality of log heads configured to form the corner joint of the building structure, each log head comprising a solid section having at least one cut away portion therein configured to receive an adjacent log head and an extension section configured to abut against the first and second starter studs displaced from the corner joint between the two walls, the log heads arranged in abutting relationship with adjacent log heads on adjacent walls to form the corner joint of the building structure, first ones of the log heads attached to the first starter stud and second ones of the log heads attached to the second starter stud, the first and second ones alternating vertically along the corner joint between the two walls; and a plurality of wall boards attached to at least one of the inner and outer wall surfaces, the wall boards arranged horizontally and spaced vertically to abut an associated one of the extension sections of the log heads; and chinking elements attached to the at least one of the inner and outer wall surfaces between the wall boards, wherein the chinking elements comprise wood boards covered with a surface material preselected to simulate chinking.

16. The building structure of claim 15, wherein the surface material comprises paint, stucco, tin roofing material, or a mesh material.

17. The building structure of claim 15, wherein the surface material is white.

18. A building structure comprising:

a foundation;

a plurality of vertically oriented, horizontally spaced studs or posts arranged on the foundation to define at least two walls joined at a corner joint, a first one of the studs or posts associated with a first wall of the two walls forming a first starter stud and being displaced alone the first wall from the corner joint between the two walls, a second one of the studs or posts associated with a second wall of the two walls forming a second starter stud and being displaced along the second wall from the corner joint between the two walls, sheathing fastened to the studs or posts to form inner and outer wall surfaces;

a plurality of log heads configured to form the corner joint of the building structure, each log head comprising a solid section having at least one cut away portion therein configured to receive an adjacent log head and an extension section configured to abut against the first and second starter studs displaced from the corner joint between the two walls, the log heads arranged in abutting relationship with adjacent log heads on adjacent walls to form the corner joint of the building structure, first ones of the log heads attached to the first starter stud and second ones of the log heads attached to the second starter stud, the first and second ones alternating vertically along the corner joint between the two walls, wherein the extension section of at least one log head comprises two parallel extensions disposed to surround opposed sides of the first or second starter stud and having a length sufficient to extend to a next stud or post.

19. A log head for use in building a corner of a building structure to simulate a log structure, the log head comprising:

a solid section having an end face and upper and lower surfaces and side surfaces, a cut away portion being formed in at least one of the upper and lower surfaces and configured to receive a vertically adjacent log head;

an extension section extending from the solid section opposite to the end face and configured to abut against a vertical stud or post; and a vertical surface formed in one of the side surfaces of the solid section adjacent to the extension section and at an angle to receive a correspondingly angled surface on an abutting wall board of a wall of the building structure, an edge of the vertical surface abutting the extension section.

20. The log head of claim 19, wherein the cut away portion comprises an angled surface formed in the upper surface.

21. The log head of claim 19, wherein the cut away portion comprises an angled surface formed in the lower surface.

22. The log head of claim 19, wherein the cut away portion comprises two notches, one of the two notches formed in the upper surface, and another of the two notches formed in the lower surface.

23. The log head of claim 19, wherein the cut away portion comprises a dove tail formed in the solid portion.

24. The log head of claim 19, wherein the log head is formed of wood.

25. The log head of claim 19, wherein the extension section comprises an extension having a length sufficient to abut against a stud or post spaced inwardly from the corner of the building structure.

26. A log head for use in building a corner of a building structure to simulate a log structure, the log head comprising:

a solid section having an end face and upper and lower surfaces, a cut away portion being formed in at least one of the upper and lower surfaces and configured to receive a vertically adjacent log head; and an extension section extending from the solid section opposite to the end face and configured to abut against a vertical stud or post, wherein the extension section comprises two parallel extensions disposed to surround opposed sides of a stud or post spaced inwardly from the corner of the building structure and having a length sufficient to extend to a next stud or post.

* * * * *